United States Patent [19]

Flüeli

[11] Patent Number: 4,609,159

[45] Date of Patent: Sep. 2, 1986

[54] THREAD WINDING GEOMETRY

[75] Inventor: Adolf Flüeli, Winterthur, Switzerland

[73] Assignee: Rieter Machine Works, Ltd., Winterthur, Switzerland

[21] Appl. No.: 597,373

[22] Filed: Apr. 6, 1984

[51] Int. Cl.[4] ..... B65H 54/42

[52] U.S. Cl. ..... 242/18 DD; 242/18 A; 242/65

[58] Field of Search ..... 242/18 DD, 18 R, 18 A, 242/65

[56] References Cited

U.S. PATENT DOCUMENTS

| | | | |
|---|---|---|---|
| 1,347,626 | 7/1920 | Foster | 242/18 DD |
| 3,042,324 | 7/1962 | Kinney | 242/18 DD |
| 3,139,239 | 6/1964 | Perry | 242/18 DD |
| 3,593,932 | 7/1971 | Altice et al. | 242/18 DD |
| 3,917,182 | 11/1975 | Lenk | 242/18 DD X |
| 4,087,055 | 5/1978 | Yasuda et al. | 242/18 DD |
| 4,120,462 | 10/1978 | Raasch et al. | 242/18 DD X |
| 4,298,171 | 11/1981 | Fluckiger et al. | 242/18 A |
| 4,394,985 | 7/1983 | Graf et al. | 242/18 DD |

*Primary Examiner*—Stanley N. Gilreath
*Attorney, Agent, or Firm*—Kenyon & Kenyon

[57] ABSTRACT

The chuck of the winding machine is mounted in cantilever manner on a carrier arm which pivots on an axis which is not in parallel with the axis of rotation of the friction drive roller. The axis of rotation of the chuck is parallel to the drive roller axis at only one position in the path of movement of the chuck towards and away from the drive roller. During winding of a cylindrical thread package, the chuck deflects under the weight of the increasing thread package. This distortion displacement is compensated by the manner in which the axes of the drive roller, and carrier arm are geometrically related.

15 Claims, 16 Drawing Figures

Fig.1
PRIOR ART
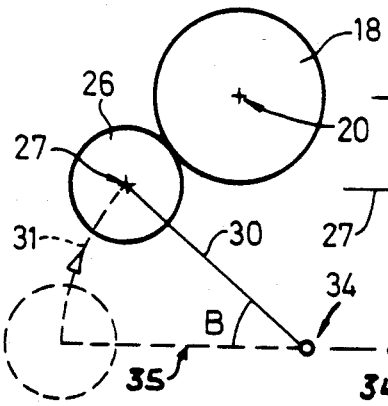
Fig.2
PRIOR ART
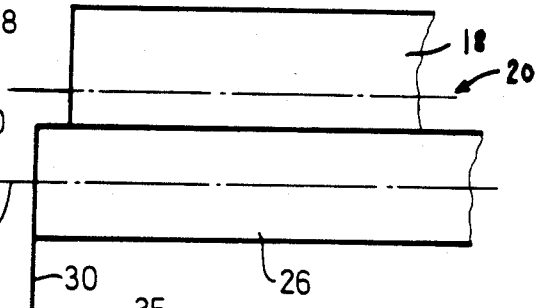
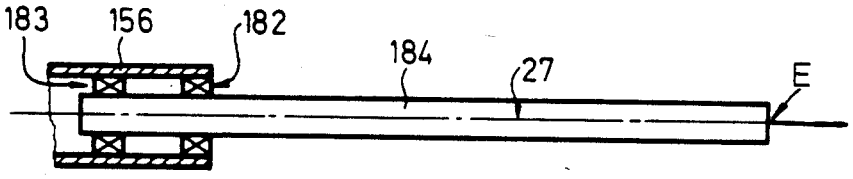
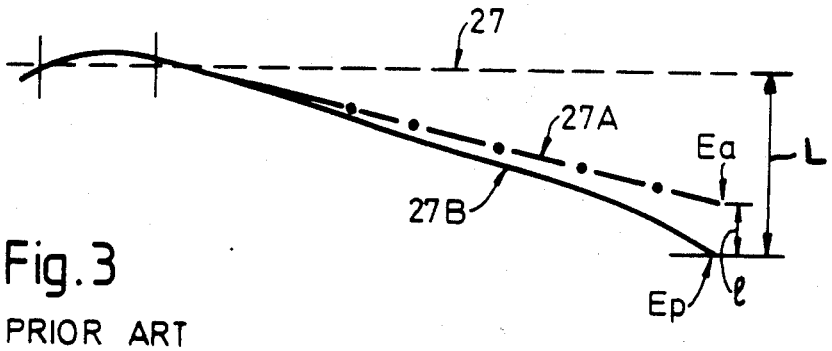
Fig.3
PRIOR ART Fig. 6A
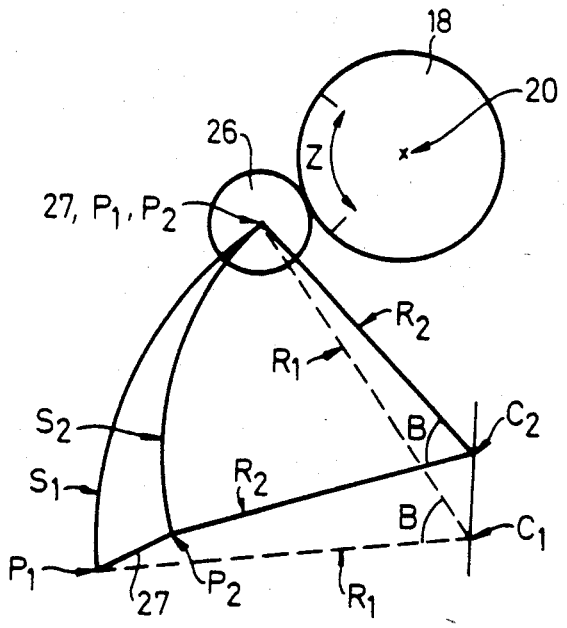
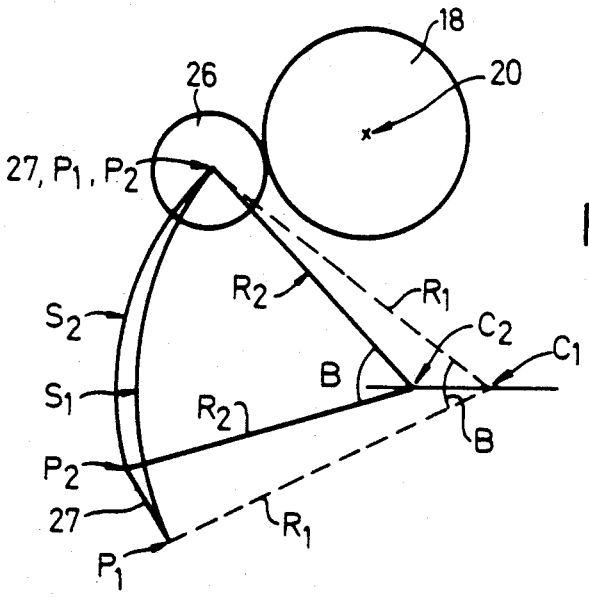
Fig. 6B Fig. 6C
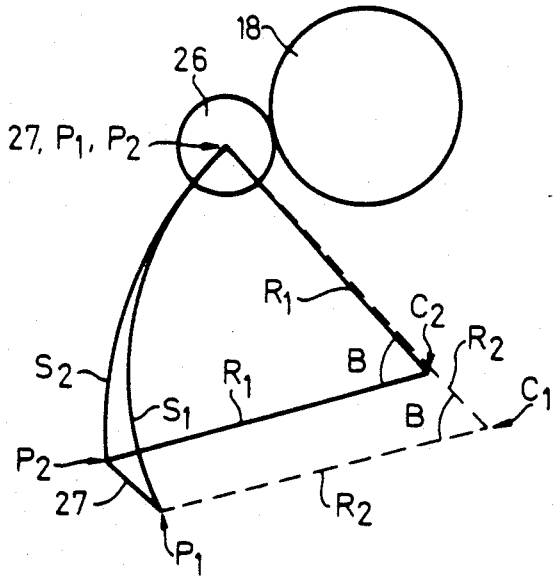
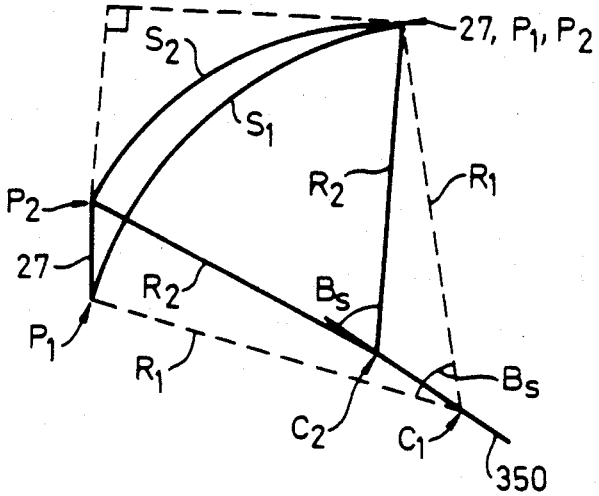
Fig. 6D

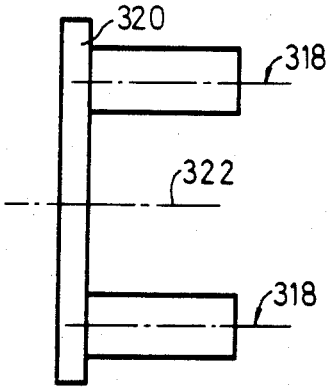
Fig. 11
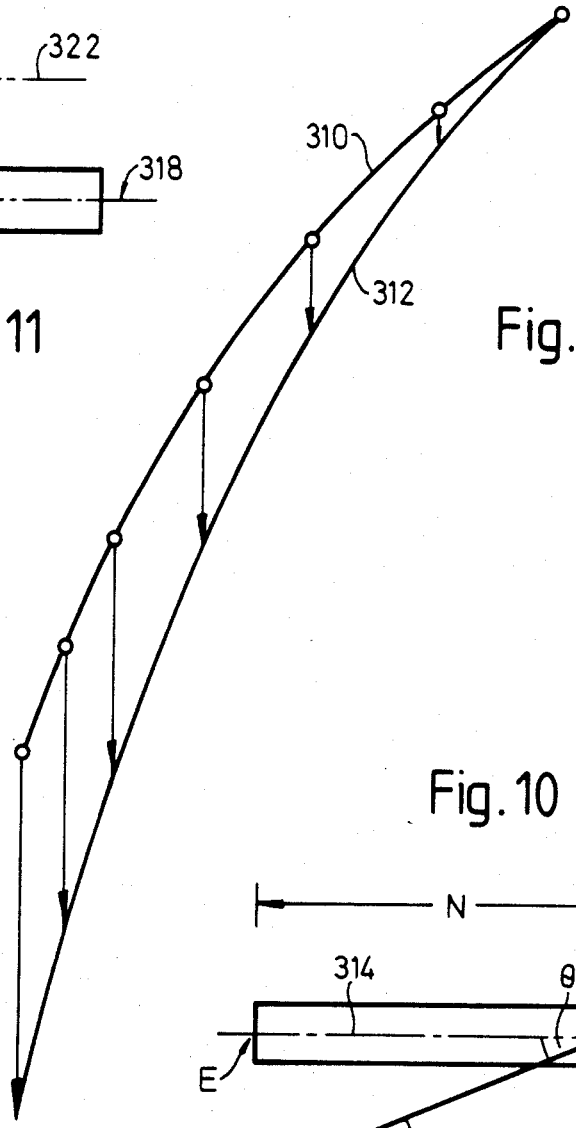
Fig. 8
Fig. 10
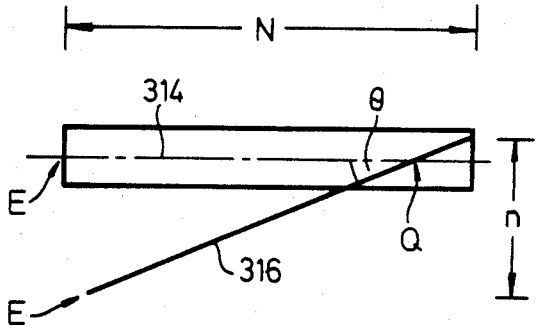

THREAD WINDING GEOMETRY

The present application relates to winding of thread into packages. As used in this specification, the term "thread" includes all thread-like structures, for example wire, yarns of all types, glassfibre strands etc. The invention is intended particularly, but not exclusively, for winding threads of synthetic plastics filaments, the threads being of monofilamentary or multi filamentary structure.

PRIOR ART

It is currently standard practice to wind a thread of synthetic plastics filament into a thread package on a bobbin tube carried by a chuck in a winding machine. For this purpose, the chuck is rotated about its own longitudinal axis ("chuck axis"), and the thread is traversed rapidly axially of the chuck through a traverse stroke approximately equal to the desired axial length of the resultant package.

It is normally desired that during formation of a thread package, the outermost layer of the package shall maintain contact over its full axial length with a "contact roller". The latter may be a friction drive roller which is driven into rotation about its own longitudinal axis, and from which drive is transferred to the chuck by frictional contact with the package. Alternatively, the contact roller may be a simple sensing roller, for example, providing an output signal responsive to the speed of rotation of the package and usable to control a drive motor directly driving the chuck. In either case, but particularly in the case of the use of a friction drive roller, it is desired to maintain a controlled contact pressure between the package and the contact roller throughout the package winding operation.

The chuck (or chucks) in a winding machine are normally cantilever-mounted, projecting for example from a front face of a headstock which contains the required drive and control units for the winding machine. There is, however, a consistent trend to lengthen the chuck and to increase the dimensions of the thread packages which can be formed thereon. At the same time, there are limits to the structural rigidity which can be designed into the individual chuck structures. Accordingly, there is virtually always a problem of bending of the chuck as it is increasingly loaded during build up of thread packages thereon, so that the "outboard" package tends to move away from the contact roller.

Such problems have been recognised over a long period and solutions have been proposed, for example, in U.S. Pat. Nos. 4,394,985, 4,087,055, 3,917,182, 3,593,932 and 3,042,324. None of those solutions is however particularly relevant to the present invention.

PRESENT INVENTION

It is an object of the present invention to at least mitigate the problems outlined above by suitable alteration of the "geometry" of the winding machine.

The invention provides improvements in a winding machine of the type comprising a contact roll rotatable about its own longitudinal axis (the "roll axis"). The machine further comprises at least one chuck also rotatable about its chuck axis. The winding machine further comprises a carrier rotatable about a predetermined "carrier axis", the chuck being mounted cantilever-fashion on the carrier. The carrier is rotatable about the carrier axis to move the chuck into an initial winding position relative to the contact roller, in which thread starts to wind around the chuck. The carrier also rotates during movement of the chuck away from said initial winding position to enable build up of a thread package between the chuck and the contact roller.

Winding machines of the general type defined in the preceding paragraph are already well known in the art. One example of such a machine can be seen from U.S. patent application Ser. No. 412,014 (corresponding with published European Patent Application No. 73930). Machines of different design, but still falling within the above defined type, can be seen from U.S. Pat. Nos. 4,298,171 and 4,548,366.

In a winding machine according to the present invention, the carrier rotation axis is not parallel to the contact roller axis. However, the chuck axis may be parallel to the contact roll axis at least at one position of the chuck relative to the contact roll during a winding operation. Preferably the one position is the initial winding position.

In more general terms, the invention provides a contact roll rotatable about its own longitudinal axis, a chuck also rotatable about its own longitudinal axis and a chuck support means, the chuck extending cantilever-fashion from its support means. Means is provided to define a mode of relative movement of the support means and the contact roll, such that the chuck axis of the unloaded chuck (that is, the chuck when it does not bear any thread packages) is substantially parallel to the contact roll axis at the most at only one relative position of the chuck and the contact roll during said relative movement. At other relative positions, these axes are skew.

Through appropriate selection of the mode of movement of the unloaded chuck, it is possible to offset or compensate distortion effects of chuck loading during a winding operation.

SHORT DESCRIPTION OF THE DRAWINGS

Embodiments of the invention will now be described in greater detail by reference to the accompaning diagrammatic drawings, in which FIGS. 1 and 2 are diagrammatic front and side elevations respectively showing the idealized "geometry" of a winder in accordance with the prior art.

FIG. 3 is a diagrammatic side elevation showing practical distortion of the idealized geometry of FIG. 2, FIGS. 4 and 5 are diagrammatic side and plan views respectively of an exaggerated winding machine geometry according to the invention, FIGS. 6A to 6D inclusive are respective diagrammatic front elevations for use in explanation of the geometry according to the invention, FIG. 7 is a diagrammatic plan view of a swing arm of a winding machine according to the invention, FIGS. 8, 9 and 10 are diagrams for use in explanation of the method of selecting machine geometry according to the invention and appropriate to given operating circumstances, FIG. 11 is a side elevation of another type of machine adaptable according to the invention, FIG. 12 is a further diagram for explanation of the new machine geometry, and FIG. 13 is a side elevation of one end of a practical swing arm for a winder according to the invention.

DETAILED DESCRIPTION OF THE DRAWINGS

Figure 4:
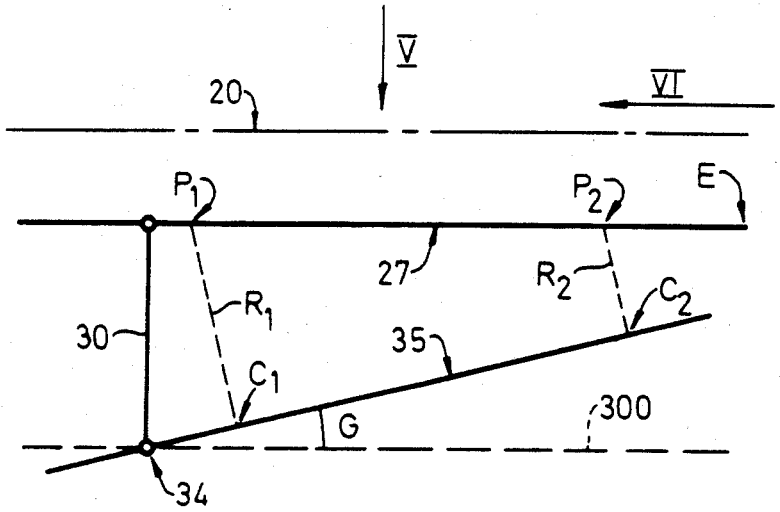

Purely by way of example, the invention will be described as applied to the lower chuck of a winding machine as illustrated in and described with reference to FIGS. 1 to 4 and 7 to 15 inclusive of U.S. patent application Ser. No. 412,014 filed on Aug. 25, 1982 and the corresponding European Patent Application No. 73930 published on Mar. 16, 1983. The full disclosure of those prior applications is hereby incorporated in the present application by reference. In order to avoid unnecessary repetition and undue length of the present specification, the general structure of the winding machine and its functions will be taken to be known from those prior applications. As far as possible, reference numerals used in the present application will correspond with those used to indicate similar parts in the prior applications.

Prior Art "Geometry"

Reference numeral 18 in FIG. 1 indicates a friction drive roller mounted in the machine headstock (not shown in FIG. 1) for rotation about its own longitudinal axis 20. Axis 20 is fixed relative to the machine and extends substantially horizontally.

Numeral 26 indicates a chuck mounted on a swingarm 30 so that the chuck is free to rotate about its own longitudinal chuck axis 27. As best seen in FIG. 2, chuck 26 extends cantileverfashion from its swingarm carrier.

Swingarm 30 is mounted in the machine frame (not shown) at 34 for rotation about an axis 35 which is fixed relative to the machine frame. Arm 30 is rotatable on its mounting 34 to swing through an arc B to move chuck 26 between an initial winding position indicated in full lines in FIG. 1 and a rest position indicated in dotted lines in FIG. 1. When chuck 26 is in its rest position any thread packages carried by the chuck are spaced from the friction drive roller 18, so that the chuck can be braked and thread packages can be removed therefrom and replaced by empty bobbin tubes ready for the next winding operation. When the chuck is thereafter moved into its initial winding position, these bobbin tubes are brought into frictional engagement with the friction drive roller so that chuck 26 is rotated about its chuck axis by frictinal contact with the drive roller. As fully described in the prior applications, threads (not shown) are transferred from the friction drive roller to respective bobbin tubes to be wound into thread packages on those bobbin tubes. As the thread packages build up around the chuck 26, the latter moves back from its initial winding position towards its rest position.

As seen in FIG. 2, axes 35 and 20 are arranged as near as practically possible parallel. Suitable arrangements for enabling adjustment of the axis of rotation of the swingarm relative to the friction roller to enable this parallel setting are illustrated in and described with reference to FIG. 10 of the prior applications. Chuck 26 is mounted on its swingarm 30 in such manner that when the chuck is unloaded, that is during movement of the chuck from its rest position into its initial winding position with only empty bobbin tubes mounted on the chuck, the chuck axis 27 is as near as possible parallel to axes 35 and 20. Thus, when swingarm 30 is pivoted on its mounting 34 through the arc B (FIG. 1) axis 27 follows an arcuate path indicated at 31 in FIG. 1. Ideally, the chuck axis should follow the same path during the return movement of swingarm 30 when the chuck is loaded, that is as thread packages build up around the chuck. However, under certain operating circumstances this ideal is not achievable, as will be apparent from consideration of FIG. 3.

Distortion of the Chuck under Load

FIG. 3 is divided into an upper part showing in diagrammatic form certain structural elements of the chuck 26, and a lower part representing in exaggerated, diagrammatic form the distortion of those parts which arises during a winding operation. The chuck structure illustrated in FIG. 3 corresponds with that shown in FIG. 11 of the prior applications, numeral 156 indicating a chuck portion which is fixedly secured to swingarm 30 and numeral 184 indicating a shaft mounted in portion 156 by first and second ball bearing units 182, 183 respectively spaced axially of shaft 184. Thus, shaft 184 and chuck portions (not illustrated) carried thereby are rotatable about axis 27. E is the free end of shaft 184 remote from swingarm 30. Since the chuck is cantilever-mounted, point E is unsupported.

When the chuck is unloaded, or only lightly loaded, then shaft 184 is straight and axis 27 extends coaxially through the bearing units 182 and 183. When the chuck is long and is loaded by heavy packages, for example as shown in U.S. Pat. No. 4,394,984, axis 27 will be distorted from its straight configuration shown in dotted lines in the lower part of FIG. 3. The portion of the chuck axis within bearing structure 182, 183, is indicated in full lines in the lower part of FIG. 3 and as shown is strongly curved in that region. The portion of the chuck axis outside the bearing structure may be assumed to remain straight as indicated by chain line 27A in the lower part of FIG. 3, giving a position Ea for the free end of the distorted shaft 184. In practice, there is also a degree of bending of the cantilevered portion of shaft 184 so that the chuck axis may follow the line 27B in the lower part of FIG. 3. The free end of shaft 184 then lies at Ep. The total displacement of the point E due to this loading distortion is then given by L, with the contribution l being due to the bending of the cantilevered shaft portion outside the bearing structure.

The result is distortion of the ideal path 31 on the return of the chuck towards its rest position. The effect of this on the winding operation will be described later.

The new Machine Geometry

Figure 5:
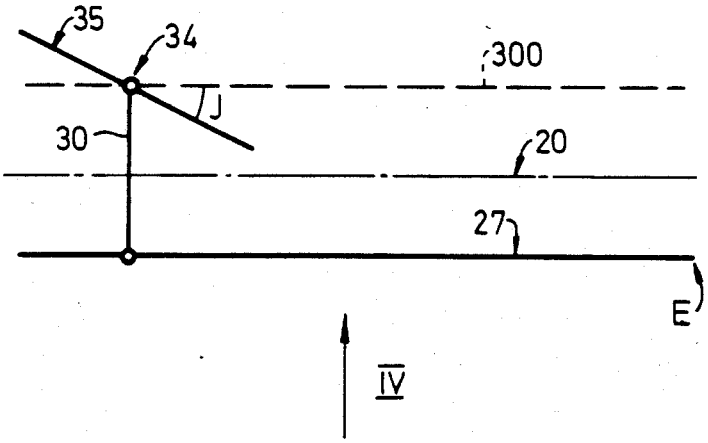

FIGS. 4 and 5 are diagrams representing the new machine geometry in a form which has been grossly exaggerated for purposes of illustration only. FIG. 4 corresponds to FIG. 2, that is it represents a side elevation with the chuck assumed to be in its initial winding position. The chuck is here represented simply by its axis 27 and the friction drive roller by its axis 20. The dotted line 300 represents a horizontal passing through the mounting 34 of the swingarm 30. Axes 20 and 27 are assumed parallel to horizontal 300. It will be seen therefore that axis 35, about which swingarm 30 pivots to move the chuck between the rest and initial winding positions, is inclined relative to the horizontal through an angle G as viewed in this side elevation.

FIG. 5 represents a diagrammatic plan view of the same system looking in the direction of the arrow V in FIG. 4, so that FIG. 4 represents a view looking in the direction of the arrow IV in FIG. 5. The horizontal 300 is assumed to run parallel to axes 20 and 27 also as viewed in plan. It will be seen that axis 35 is set at an angle J to the horizontal 300 when viewed in plan. In both of the FIGS. 4 and 5, the swingarm has been represented by a simple straight line 30 extending between the axes 35 and 27. Its disposition relative to these axes is not important to the principles to be explained by reference to these diagrams; it will however be of practical significance to the assembly and design of the machine which will be referred to later in this specification.

In FIGS. 4 and 5, the chuck has been assumed to lie in its initial winding position, and is therefore substantially unloaded. Axis 27 is straight and its spacing from axis 20 is constant over the length between the swingarm 30 and free end E of shaft 184. This gives at least line contact of each bobbin tube carried by chuck 26 with the friction drive roller 18 over the full length of the bobbin tube. Consider now two imaginary lines R1 and R2 respectively each extending radially relative to axis 35 and joining that axis to axis 27. Line R1 is assumed to meet axis 27 at a point P1 adjacent swingarm 30. Line R2 is assumed to meet axis 27 at a point P2 adjacent the free end E of shaft 184. Lines R1 and R2 intersect axis 35 at points C1 and C2 respectively.

Consider now the loci of movement of the points P1 and P2 as viewed in front elevation, i.e. in the direction of the arrow VI in FIG. 4, as the unloaded chuck moves between its rest and initial winding positions. The diagrams in FIGS. 6A, 6B, 6C and 6D represent such loci for varying assumptions regarding angles G and J.

In FIG. 6A, the points C1 and C2 are assumed to lie in a common vertical plane, so that the angle J (FIG. 5) is zero. C2 lies above C1, so that angle G (FIG. 4) is greater than zero. When chuck 26 is in its initial winding position as shown, both P1 and P2 lie on a common horizontal containing chuck axis 27. Assume now that swingarm 30 sweeps through the angle B (FIG. 1), returning chuck 26 to the rest position, but without carrying out a winding operation so that the chuck remains unloaded. Point P1 sweeps out the segment S1 in FIG. 6A and point P2 sweeps out the segment S2.

Accordingly, when the chuck is in its rest position, the axis 27 is inclined relative to the horizontal with the point E lying above the connection of chuck 26 with the swingarm 30 and also lying substantially closer to the axis 20 as viewed in front elevation. With this arrangement, however, most of the "compensatory displacement" (as defined in the next paragraph) appears as a horizontal displacement.

For ease of identification and clarity of description the word "displacement" as used herein refers to displacement or deviation of an arbitrarily selected point on the chuck from the "ideal path" of that same point in the "ideal geometry" according to FIGS. 1 and 2. A "displacement" caused by chuck distortion under load is referred to as a "distortion displacement" and a displacement caused by the new geometry is referred to as a "compensatory displacement" or "compensation displacement".

Consider now FIG. 6B in which the points C1 and C2 are assumed to lie in a horizontal plane, that is the angle G in FIG. 4 is assumed to be zero but the angle J (FIG. 5) is assumed to be greater than zero. It will be readily apparent that most of the "compensatory displacement" of axis 27 now appears as a vertical displacement with the point E lying, in the rest position, substantially higher than the region of connection of chuck 26 with swingarm 30.

FIG. 6C illustrates the corresponding geometry for angle G=angle J=45 degrees. It will be understood that this angle is chosen purely for purposes of demonstration of the effect and has no particular practical significance.

Distortion Compensation

It is believed to be apparent that the vertical component of the compensatory displacement of the points P1 and P2 during their movement through the arcs S1 and S2 in FIG. 6A will act to compensate distortion of the chuck due to static loading during the winding operation. As clearly seen in FIG. 3, the static loading of the chuck, caused by the increasing weight of the packages forming thereon, tends to depress the point E relative to the connection of the chuck with its swingarm 30. The compensation displacement referred to above in the description of FIG. 6A tends, however, to raise the point E relative to the connection of the chuck with the swingarm. By appropriate selection of the machine geometry, while taking into account the specific structure of the chuck and the packages for which the machine is designed, it will be possible to compensate at least partially chuck distortion produced during a winding operation.

At first sight, the horizontal compensation displacement of points P1 and P2 in FIG. 6A represents an additional error in the system. Even where this interpretation is correct, however, the overall error can be made much smaller when the new geometry is employed than the corresponding error introduced by static loading into a winding system using the standard geometry of the prior art. Furthermore, this horizontal compensation displacement can also prove advantageous in embodiments of the illustrated type in which the winding zone Z (FIG. 6A), in which the thread is transferred from the friction drive roller 18 to the package, is bounded by a small arc on the circumference of the drive roller intersected by a horizontal plane containing the axis 20 of the drive roller. In such an arrangement, horizontal compensation displacement of the point E towards the axis 20 (as in FIG. 6A) will tend to maintain the outboard package in driving contact with the friction roller 18. Thus, the practical effect of this "theoretical error" can prove advantageous.

Furthermore, this system can be so designed that the horizontal component of the compensation displacement of points P1 and P2 has a true "compensating" effect if, for example, the system is so arranged that chuck 26 as it approaches its initial winding position first makes "point contact" instead of line contact with the friction roll 18 at a point adjacent the outboard end of the chuck, that is adjacent the point E. The chuck can application of additional force to the swingarm 30 so as to "prestress" the chuck; this requires a horizontal movement of the point E relative to the connection between the chuck and swingarm 30. The chuck can easily be designed to absorb such prestressing, which can in any event be minimized by designing friction roll 18 to distort slightly in response to the "overpressure" required to ensure the desired parallel relationship of axes 20 and 27 when the chuck is in its initial winding position. As the winding operation proceeds, the horizontal component of the compensation displacement can be made to balance out at least partially the initial "angled setting" of the chuck axis, so that the "overpressure" can be reduced or eliminated as the relatively soft package builds up between the chuck and friction drive roll (for example as in FIG. 6B).

Practical Embodiments

Figure 7:
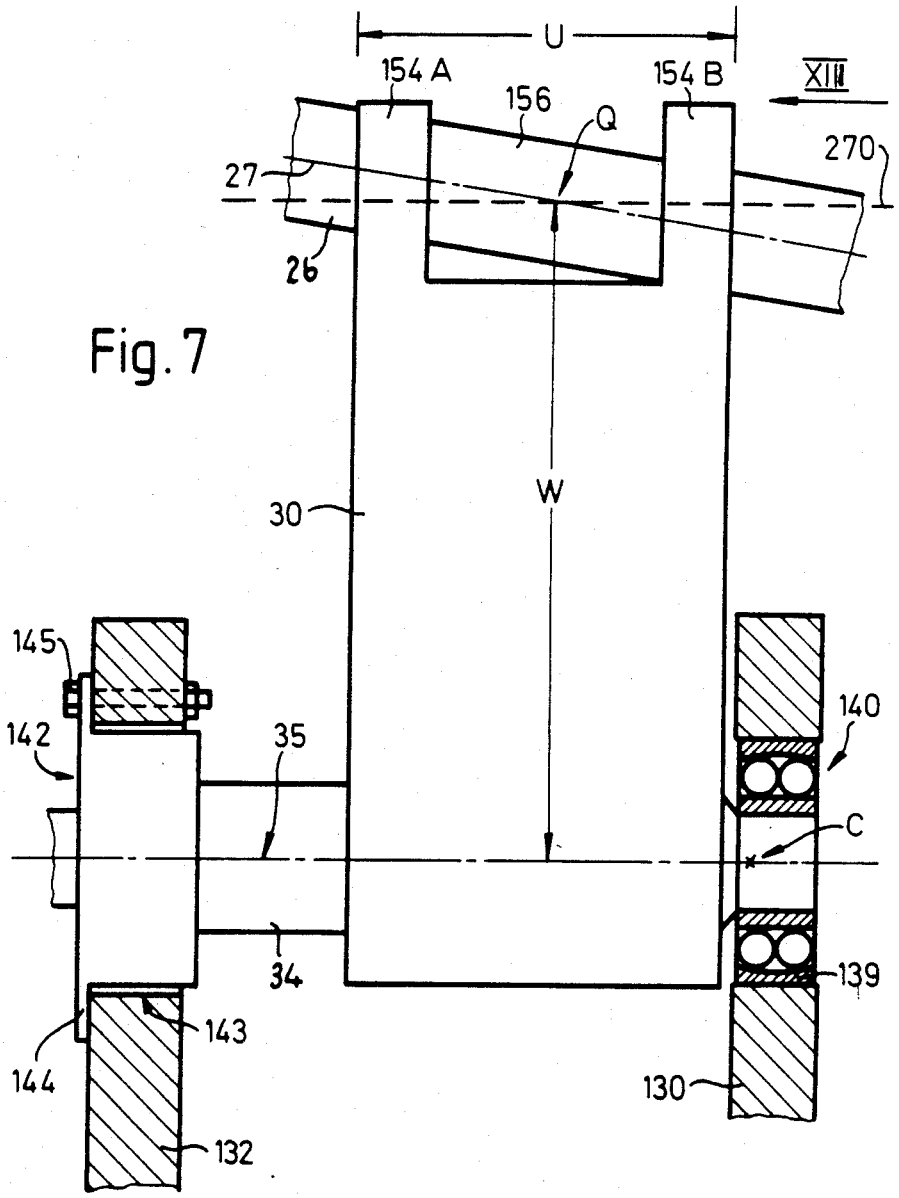

Referring to FIG. 7, the swingarm for the lower chuck of a winding machine can be mounted in a manner so as to bring about the desired movement of a chuck. Whereas FIG. 7 of the present system illustrates the lower chuck of such a machine, the relevant principles are the same for both chucks. Slight differences in the preferred application of those principles to the upper and lower chucks respectively will be described later.

Numerals 130 and 132 indicate the load bearing partitions in the headstock of the machine shown in FIGS. 8 to 14 of the prior application. The swingarm is again indicated at 30 and it extends radially from its mounting shaft 34 which is supported between the partitions 130 and 132 by a bearing system which will be described later. At its end remote from shaft 34, arm 30 has clamping jaws 154A and 154B clamping the fixed portion 156 (see also FIG. 3) of the chuck 26. The axis of shaft 34 is again indicated at 35. In the arrangement shown in application Ser. No. 412,014, jaws 154 were arranged to hold the chuck with its chuck axis parallel to the shaft axis 35, for example on the dotted line 270 in FIG. 7. The jaws 154A and 154B shown in FIG. 7 are arranged to hold the chuck with its axis 27 canted in a predetermined manner relative to the line 270.

The drawing shows the cant in one plane only; the cant may also have a comparent in a horizontal plane at right angles to the plane of the drawing. The cant to be provided in an individual case is discussed further below.

The bearing unit 140 mounting shaft 34 in partition 130 comprises an outer ballrace 139 with a part-spherical surface. The bearing unit 142 mounting shaft 34 in partition 132 is "undersize" relative to its receiving opening 143 in the partition, and is secured to the partition by means of flange 144 and bolts 145 which pass through enlarged openings (not shown) in partition 132. The arrangement enables shaft 34 to be adjusted to any desired position within a "cone of adjustment" having an apex at the point C within the bearing unit 140.

The friction drive roller 18 is also mounted in the load bearing partitions 130, 132 with its axis 20 extending at a predetermined disposition relative to those partitions. When the chuck and arm assembly has been assembled, generally as shown in FIG. 7, arm 30 can be pivoted on shaft 34 in order to bring chuck 26 into contact with the friction drive roll. Due to the "canted" disposition of axis 27 relative to arm 30, the chuck will only make point contact with the drive roll. The bearings for shaft 34 can now be adjusted in order to bring chuck axis 27 into the desired disposition relative to roll axis 20. This can involve line contact of the chuck with the drive roller without any "overpressure" applied to the arm 30, or a slight "angled alignment" of axis 27 relative to arm 20 so that the "overpressure" described above is needed to force the chuck into the initial winding position in which line contact is achieved.

For ease of identification and clarity of description, the displacement of the chuck axis 27 from the line 270 (FIG. 7) will continue to be referred to hereinafter as the "cant" of the chuck axis; the corresponding adjustment of the carrier axis 35 to return the chuck axis to the initial winding position will be referred to as "tilt" of the carrier axis.

Selection of Appropriate Geometry—Preliminaries

Consider once again the diagram in the lower portion of FIG. 3. If the cantilevered portion of shaft 184 is relatively stiff in resisting bending loads, then l will represent only a small proportion of L. It will then be satisfactory to compensate bending of the chuck by compensating the distortion displacement of a point, such as point E, at the free end of the chuck. The resulting minor errors in compensation along the length of the chuck will be very small and can be neglected.

If, on the other hand, the cantilevered portion of shaft 184 bends significantly under the anticipated loads, then l will represent a significant proportion of L, and it will no longer be satisfactory to compensate by reference to the point E. In this case, a point closer to the inboard end of the chuck must be chosen so that the compensation effect is "averaged" over the length of the chuck.

Wherever the "compensation point" is selected, it will normally be undesirable to rely upon calculation of the distortion displacement of the compensation point from the "ideal path". This is because the total distortion displacement suffered by the compensation point depends not only upon the structure of the chuck; to a degree, this distortion displacement depends upon the overall design of the machine, and significant influences on the relevant displacement are to be expected from at least the design of the swingarm and the mounting therefor. Accordingly, it will normally be preferable to measure the distortion displacement. Since this displacement is caused by static loading under the package weight, such measurement can be effected quite easily if the relevant weights are applied to the chuck while the machine is not in operation. By this means, a diagram can be prepared, for example as shown in FIG. 8, showing the anticipated distortion displacement of the selected compensation point from the "ideal path" in given operational circumstances.

In FIG. 8, the "ideal path" is indicated by numeral 310 and the anticipated path along which the compensation point will actually travel if the chuck remains uncompensated is indicated at 312. The "ideal path" represents the path of movement of the selected compensation point when the chuck is unloaded. The anticipated actual path can be derived from the "ideal path" by taking a series of measurements (represented by the vertical lines joining the two paths in FIG. 8) representing downward deflection of the compensation point when various different static loads are applied to the chuck. These varying static loads can be related to the various stages of package build during a specific winding operation, and thus can be related to a specific position of the chuck along its "ideal path".

The problem of selecting the appropriate winder geometry therefore reduces to the problem of "matching" the compensation effect obtainable from the new geometry with the distortion displacement diagram obtained as described above. As will become clear from the following description, the operation of "matching" does not necessarily involve the closest possible approach of the compensated path to the "ideal path"; the best compromise for the actual intended operating circumstances must be sought in each case.

In view of the large number of factors which will affect the geometry to be chosen in any individual case, it is of little value to provide hard and fast rules for selection of winder geometry in this specification. Instead, various methods of approach to the selection of the geometry of a specific winder will be indicated below. These approaches are not, however, intended to be exhaustive.

Selection of Appropriate Geometry—Procedure

Consideration of FIGS. 6B and 6C will show that the system can be so arranged that the compensation effect is purely vertical at one angular position of the swingarm 30. One approach to matching of the compensation effect therefore lies in location of this purely vertical compensation relative to the swinging movement of the arm 30 in the practical winder design. As indicated in FIG. 6D, this reduces to the problem of identifying the position at which the points P1 and P2 after swinging through the same angle Bs about the axis 350 (which is inclined to the plane of the drawing) reach a position at which they are vertically spaced. At the same time, the magnitude of the compensation must be adapted to the anticipated distortion of the chuck. Such a problem could conveniently be subjected to computer design analysis.

Figure 9:
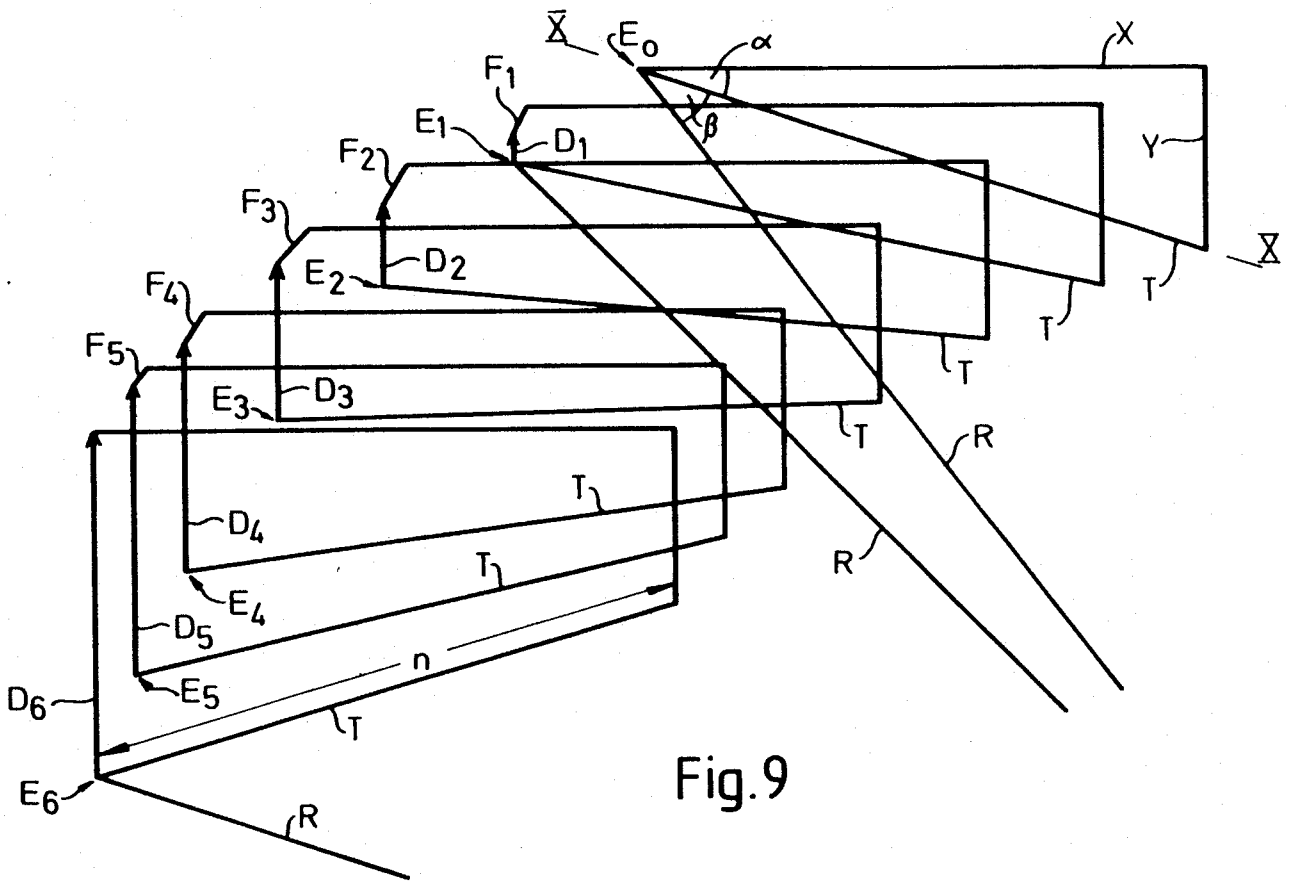

FIG. 9 represents an alternative approach which is more suited to normal drawing board solution; as will become clear from the following description, this Figure also shows the substantial improvement which can be obtained by means of the present invention. For convenience, this Figure assumes a compensation point E at the free end of the chuck, but the relevant principles are applicable also to any other selected compensation point.

In FIG. 9, the curve (not drawn) joining the points E0 to E6 inclusive represents the "ideal path" of the point E during a winding operation, that is while thread is actually being wound into thread packages carried by the relevant chuck. E0 represents the initial winding position, and E6 represents the point at which the winding operation is broken off and the completed thread packages moved away from friction contact with the drive roller. The lines R represent radii extending to the center of this "ideal path".

The lines T represent the disposition of the unloaded, but canted, chuck axis (27, FIG. 7) relative to the radius R as viewed axially of the friction drive roller. The lines X and Y represent horizontal and vertical components respectively of the tilt applied the swingarm and hence to the chuck carried thereby (for example, by adjustment of bearing unit 142 as decribed above with reference to FIG. 7) so as to return the chuck to the horizontal disposition at the initial winding position E0.

The lines D1 to D6 represent the compensation displacement required at the points E1 to E6 respectively to balance out the distortion of the chuck (as represented by distortion displacement of the point E) due to static loading during a particular winding operation. These lines simply represent inversion of the distortion displacements illustrated in FIG. 8. Assume now that it is desired to compensate as closely as possible the distortion displacement of E at completion of the winding operation, that is at the position E6. Then, the effect of the cant of the chuck relative to the swingarm (represented in FIG. 9 by the line T) and the effect of tilting of the swing axis of the arm itself (represented in FIG. 9 by the horizontal and vertical components X and Y) must exactly cancel the relevant chuck distortion (represented in FIG. 9 by the line D6)—that is, the lines T, Y, X and D6 must form a closed figure.

The achievement of such a result can conveniently be reduced to two steps, namely (1)the selection of the angles $\alpha$ and $\beta$ such that the compensation effect is purely vertical at point E6, and (2) the adjustment of the chuck axis in the plane X—X (normal to the plane of the drawing and containing the line T) so that the vertical compensation effect at point E6 exactly balances the chuck distortion at the same point.

Step 1:

Examination of the geometry of FIG. 9 will show that the desired vertical disposition of the compensation effect at E6 can be obtained if angle $\alpha$ (where tan $\alpha$ equals Y/X) is equal to half the swing angle of the radius R between the points E0 and E6. Angle $\beta$ is an independent variable and can be chosen to have any desired, practical value.

Selection of angles $\alpha$ and $\beta$ in this compensation technique effectively involves selection of a plane (indicated at X—X in FIG. 9) in which adjustment (cant) of the chuck axis relative to the swing arm is to be effected. It represents at the same time selection of a parallel plane in which counter-adjustment (tilt) at the swingarm mounting is to be effected in order to return the chuck to a desired disposition relative to the friction roll axis (or other contact roll axis, where friction drive is not used) at the initial winding position. The magnitude of the adjustment has yet to be determined and will be dealt with below in step 2.

In practice, the free end of the chuck should be adjusted towards the friction roll so that the angle $\alpha+\beta$ represents the angle between the radius R at E0 and a horizontal at that position. Since $\beta$ has no effect upon the desired compensation, the disposition of R at E0 can be determined by machine design factors other than the compensation technique now proposed and for purposes of that technique can be taken as given. For a given length of swingarm, the swing angle of the arm depands only on the package size Thus angle $\alpha$ is the relevant control variable.

Two additional points are worth noting (a) the only relevant portion of the total angle of swing of arm 30 for compensation purposes is the portion associated with actual package winding. The portion of the swing path between the point of breaking off winding and the rest position can be ignored.

(b) it is not essential that the theoretically available region of purely vertical compensation actually occurs in the portion of the swing path associated with package build, or even in the swing path defined by the machine. The location of this region at one particular position on the swing path has been taken as one example only of a possible matching operation—other matching processes, using other criteria, can be adopted to suit individual requirements.

Step 2:

Assuming that the angles $\alpha$ and $\beta$ have been selected to match the required operating circumstances, the second step outlined above must now be taken. In the closed figure T, Y, X, D6 in FIG. 9, the length of the line D6 will be fixed (in accordance with any desired scale) proportional to the actual measured distortion displacement at the stage of the winding operation represented by point E6 in FIG. 9. This enables calculation, or measurement, of a corresponding length n along line T appropriate to produce the desired closed figure. Consider now the plane X—X as indicated in FIG. 9 and represented (on a reduced scale) in FIG. 10. In FIG. 10, the line 314 represents the disposition of the chuck axis in the theoretically ideal model shown in FIGS. 1 and 2. The line 316 represents the disposition of the same axis after it has been canted relative to the swingarm (about a point Q located somewhere in the chuck mounting—see FIG. 7), but before the swingarm itself has been tilted in order to return the chuck axis to the horizontal disposition at E0. The length of the chuck is given by N; this should be drawn to the scale adopted for representation of the required compensation displacement D6 in FIG. 9, but has been considerably reduced in FIG. 10. The measured value n in FIG. 9 now represents the vertical spacing in FIG. 10 of the ends of the chuck in its canted disposition, and the lengths n and N together give the required adjustment angle $\theta$.

The required tilt of the swingarm is also given by the angle $\theta$ and this tilt of the swingarm must be effected in a plane parallel to plane X—X. In practice, it is not necessary to identify the plane or magnitude of tilt of the swingarm—the latter is simply tilted so as to "cancel out" the effect of the cant of the chuck at position E0.

The geometry of the system is thus defined, and the resultant errors at positions E1 to E5 inclusive can be estimated as shown in FIG. 9, those errors being represented by the lines F1 to F5 respectively. The magnitude of the error at position E1 is substantially equal to the effect of the distortion of the chuck at this position, so that little improvement is to be expected at this stage of the winding operation. On the other hand, the magnitude of the distortion is in any event small at this stage and is quite acceptable. With increasing package weight as the winding operation moves through phases represented by E2 to E5 respectively, the very large improvement obtainable by means of the invention can be seen by comparison of F2 to F5 with the respective compensation displacements D2 to D5 respectively. Finally, a theoretical zero error is obtained at position E6 despite the relatively large distortion of the chuck at this stage of the winding operation.

Variations

By way of example, the invention has been described by reference to the lower chuck of an automatic winding machine of the type shown in U.S. patent application Ser. No. 412,014. The invention can of course be applied equally to correction of the effects of chuck distortion on a winding operation on the upper chuck of that same machine. In this case, however, it may be preferred to build in a deliberate small error into the compensated path of the chuck, because the package weight and the resultant chuck distortion are in any event tending to move the free end of the chuck downwardly into contact with the friction drive roller. In such a case, it is important to avoid "overcompensation" and it may therefore be preferred to err on the side of undercompensation.

The invention is quite clearly applicable to winding machines having only a single chuck, particularly where that chuck is carried by a swingarm swinging from either above or below the friction drive roll. It should also be apparent, that the invention is applicable to alternative types of automatic winding machines, for example the well known "revolver"-type as shown for example in U.S. Pat. No. 4,298,171. In such a machine, the cant of the chuck relative to its swingarm in the embodiment described above finds an equivalent in cant of the chuck axes (318, FIG. 11) relative to the revolver head (320, FIG. 11), and tilting of the swingarm at its mounting finds an equivalent in tilting of the axis (322, FIG. 11) of rotation of the revolver head itself. Since the principles applicable are exactly the same as those already described for swingarm embodiments, it is believed that more detailed description of the revolver-type embodiment is unnecessary.

The invention is, also applicable at least in theory to machines such as those shown in U.S. Pat. No. 4,394,985 in which no rotary movement is involved in movement of the chuck from its rest to its initial winding position. In such a case, instead of (or in addition to) providing a force applying means to force the packages against the friction drive roll, the guide means defining the path of movement of the carriage which bears the chuck in the embodiment shown in that patent can be modified to define a curved path of movement for the carriage. By suitable adaption of this curved path of movement, the compensating effect described above for rotary embodiments can be obtained also in these previously linear embodiments. Economic manufacture of such a guidance system is, however, liable to prove problematic.

The described embodiments used the preferred arrangement in which the winding zone Z (FIG. 6A) is disposed about a horizontal plane passing through the axis of the friction drive roller. This is not essential. The winding zone can be shifted from this optimum disposition towards a position in and around a vertical plane containing the axis of the friction drive roller. However, the effectiveness of the available compensation is liable to be reduced as the winding zone is shifted towards the vertical.

The invention is not limited to details of the swingarm and mounting arrangement described with reference to FIG. 7. As has been shown above by reference to the revolver-type embodiments, many different winding structures can be adapted in accordance with the present invention. FIG. 7 does, however, emphasize the fact that the invention can be applied to existing winding structures with only very simple modifications in those structures.

Achievable Effects

It must be emphasized that the distortion displacements which must be compensated by means in accordance with this invention are very small. They have been grossly exaggerated in the drawings of this specification for purposes of clarity of illustration. For example only, distortion of the winder chuck producing a displacement at the free end thereof of as little as 1 to 2 millimeters from its "ideal path" can produce very significant practical effects in terms of package quality, of the type referred to below.

The most obvious effect of chuck distortion in an uncompensated system is the appearance of "saddles" in the outboard packages. Such packages have raised "shoulders" with a trough between the shoulders when the packages are viewed in longitudinal cross section. An associated effect which is also well known to users of such machines is variation in the "hardness" of the package.

Due to the chuck distortion, the greater proportion of the contact pressure between the packages and the friction drive roll is borne by the inboard packages. They are correspondingly compacted and "hard", the outboard packages being soft in comparison. A further effect of lack of compensation is variation in the diameter of the packages along the chuck in a given winding operation, the package diameter gradually increasing towards the outboard end of the chuck. Furthermore, the outboard packages may in some cases have a substantially conical outer form.

By appropriate choice of a "compensation curve" in relation to a measured "distortion curve" (see FIG. 8) it is possible in many cases to virtually eliminate the above effects.

Formula for Matching

Figure 12:
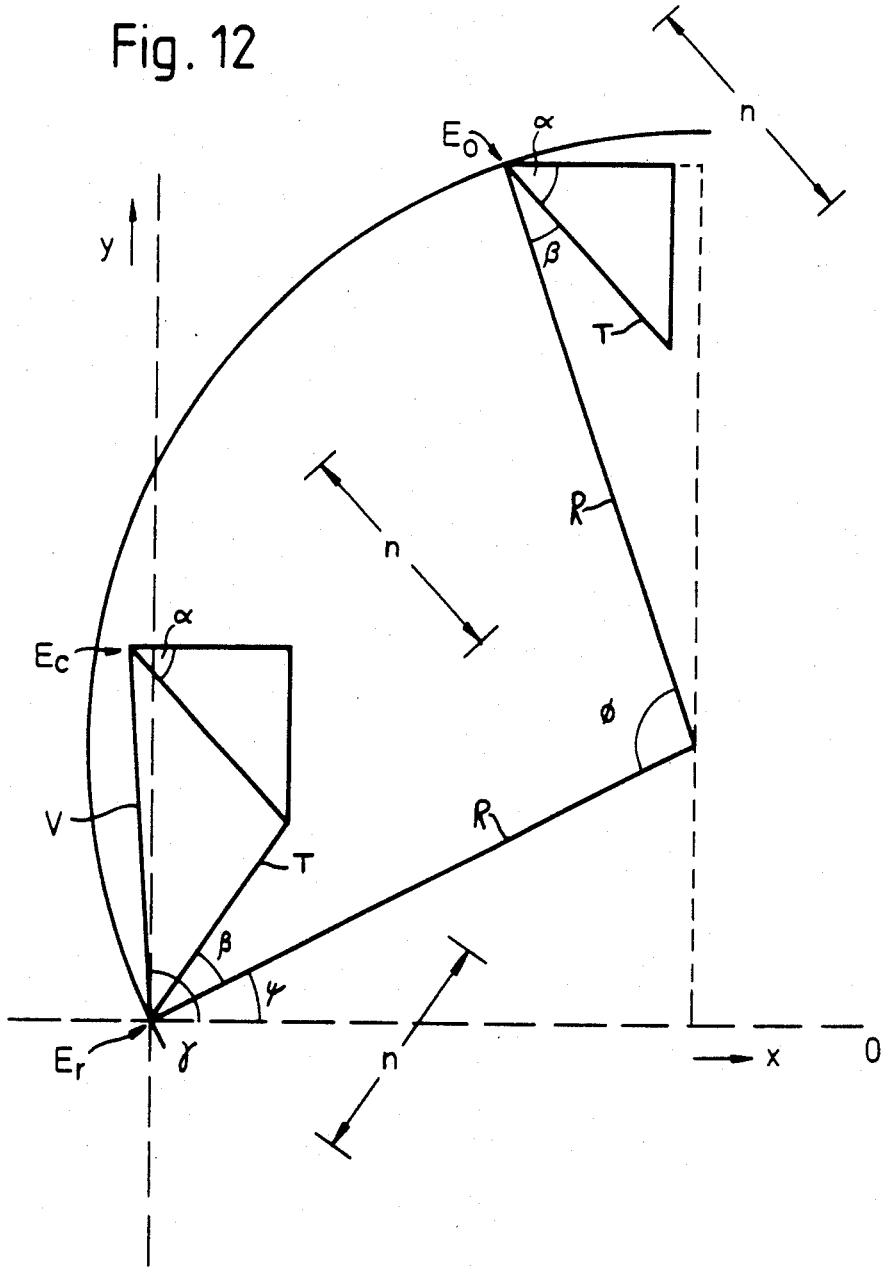

By means of the theoretical analysis represented by FIG. 12, it is possible to derive a formula which can be used for matching the new geometry to specific practical requirements. In FIG. 12, the radii R correspond to the same radii shown in FIG. 9 and a semi-circular locus has been drawn through points corresponding to E0, E1 etc. in FIG. 9. The "starting point" E0 has been indicated on the upper portion of this curve.

The point Er represents any arbitrarily selected point on this curve corresponding to an arbitrary swing angle $\phi$. A system of cartesian co-ordinates is assumed to have its origin at Er, the vertical y-axis and the horizontal x-axis being shown on FIG. 12 in dotted lines. Angle $\psi$ is simply the angle between the horizontal x-axis and the radius R at the arbitrarily selected point Er.

The lines T and the angles $\alpha$ and $\beta$ in FIG. 12 correspond to the similarly indicated elements of FIG. 9, and the length n indicated in FIG. 12 has the same significance as the length n described with reference to FIGS. 9 and 10.

Point Ec is the "compensated position" corresponding to the swing angle $\phi$. It is derived by the methods already described with reference to FIG. 9. The line V can be called a "compensation vector" representing the difference between the "ideal geometry" of FIG. 1 and the new, compensated geometry. Angle $\gamma$ is the angle between vector V and the positive portion of the x-axis.

The co-ordinates of the point Ec are given by:

$$x\,(Ec)=n\cos(\beta+\psi)-n\cos\alpha$$

$$y\,(Ec)=n\sin(\beta+\psi)+n\sin\alpha$$

By considering the triangles produced by the vertical dotted line parallel to the y-axis, it is clear that:

$$(\beta+\psi)=(\phi-\alpha)$$

By means of standard trigonometrical multiple angle formulae, it can then be shown that:

$$v^2=x^2+y^2=4\,n^2\sin^2\phi/2$$

i.e.

$$V=2\,n\sin^{\phi}/2$$

Furthermore, using the same formulae it can be shown that $$\text{Tan Angle } \alpha=\frac{y}{x}=-\cot\frac{\phi-2\alpha}{2}$$

$$=\text{Tan}\left(90+\frac{\phi}{2}-\alpha\right)$$

$$\text{i.e. Angle } \alpha=90+\frac{\phi}{2}-\alpha$$

These relationships apply for any arbitrarily selected point Er and they thus represent a "compensation function" in terms of n, $\alpha$ and $\phi$. Assuming that for a given practical application, the desired compensation is known for different values of $\phi$ (e.g. by taking sample distortion measurements as described above), matching can be effected by selection of varying values of n and $\alpha$ for the compensation function.

PRACTICAL EXAMPLE

Purely by way of example, the following data retlating to a practical winder are provided. The data relate to the lower chuck of a winder in accordance with FIGS. 8 to 12 of prior U.S. patent application Ser. No. 412,014, the chuck and mounting being in accordance with FIG. 7 of this application. The data will be quoted for a given winding operation (filament type, number of packages etc.), the details of which are believed irrelevant to the example:

| | |
|---|---|
| Width of swingarm as represented by U in FIG. 7 | 226 mm |
| Length of swingarm as represented by W in FIG. 7 | 250 mm |
| Length of chuck extending from outboard edge of swingarm | 936 mm |
| Maximum package diameter | 360 mm |
| Maximum package weight of all packages carried by chuck in the given winding operation | 64 kg |
| Angle $\alpha$ (FIG. 9) | 18,5° |
| Angle $\beta$ (FIG. 9) | 36° |
| Length n (FIGS. 9 + 10) | 3 mm |
| Angle $\theta$ (FIG. 10) | 0,19° |

| Swing angle $\phi$ (degrees) | Length D (FIG. 9) mm. | Length F (FIG. 9) mm. |
|---|---|---|
| E1 6 | 0,22 | 0.09 |
| E2 13 | 0,63 | 0.21 |
| E3 19.8 | 1,00 | 0.21 |
| E4 26.7 | 1,36 | 0.15 |
| E5 31.2 | 1,61 | 0.098 |
| E6 35.6 | 1,8 | 0 |

Figure 13:
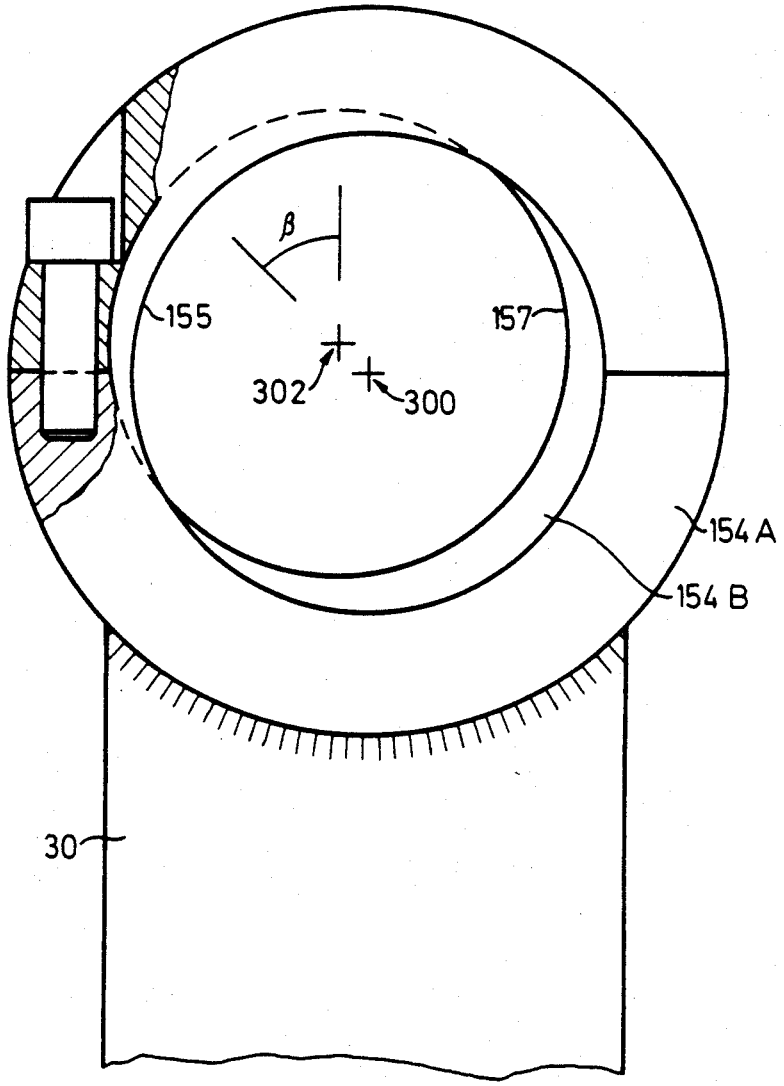

FIG. 13 shows a means by which the required setting of the chuck relative to the swing arm (the "cant") can be produced in practice. This Figure shows the swingarm 30 and jaws 154A and 154B (the latter being only partly visible) as viewed in the direction of the arrow XIII in FIG. 7 and with the chuck omitted. The front edge or rim of the cylindrical bore through jaw 154A is indicated at 155 and the rear edge or rim of the cylindrical bore through jaw 154 B is indicated at 157.

Edge 155 is centred at 300 and edge 157 is centred at 302. The bores of jaws 154A and 154B are drilled on a common axis joining centres 300 and 302. The required offset of these centres can be determined by reference to the compensation geometry described above and the dimensions of the parts. This offset determines the "cant" referred to above, the angle $\beta$ (FIG. 9) being given by the angle between a line joining the centres 300, 302 (as viewed in end elevation, FIG. 13) and a radius extending to the axis 35 (FIG. 7).

Such a system produces a fixed cant of the chuck relative to its arm. Alternatively, replaceable pairs of bushes could be inserted as liners in respective jaws, the bushes of a pair having bores drilled on a common axis lut the pairs having respective different offsets of their centres corresponding to centres 300, 302 in FIG. 13. The cant could then be varied by selecting a different pair of bushes. Alternatively each jaw could have adjustable setting elements, e.g. screws, to hold the chuck in a selectively variable disposition relative to the jaw. Furthermore, each jaw could have a pair of excentres, adjustable and securable relative to each other thereby forming a "universal joint" (with a limited degree of adjustability) with the chuck.

The description thus far has assumed that the new geometry is achieved by adjustment of the chuck and carrier (swingarm) axes relative to a fixed, horizontal contact (friction) roll axis. This is not necessary. In fact, where tilting of a horizontal carrier axis is not possible (for example, as may be the case in retrofitting an existing revolver-type winder with a system according to this invention), it will be essential to "tilt" the contact roll axis instead in order to obtain the desired relation between the chuck and the contact roll in the initial winding position. Alternatively the "tilt" could be shared between the contact roll and swingarm axes.

This could introduce an additional complicating factor into the matching procedure. This complication can be identified by further consideration of FIGS. 9 and 12 and the assumptions underlying those Figures. Each Figure represents the geometry of the system in a plane normal to the chuck axis at the compensation point, E. This plane will be referred to as the "compensation plane" (corresponding to the "compensation point")—it is not to be confused with the "adjustment plane" X—X already described above. Now, if the chuck axis is horizontal in the initial winding position, and hence throughout the "ideal geometry" movement, the compensation plane is vertical.

Consider now the distortion diagram of FIG. 8. This is representative of distortion in a vertical plane ( the "distortion plane") at the compensation point, E. Accordingly, when the chuck axis is horizontal in the initial winding position, the compensation plane and the distortion plane are identical. However, when the axis of the contact roll is tilted, and hence the axis of the chuck in its initial winding position is correspondingly inclined relative to the horizontal, the compensation plane and the distortion plane will no longer be identical, because the distortion plane is always vertical. For small tilt angles, the complication can be ignored. For exact matching, the problem can be solved by mapping either the compensation function onto the distortion plane, or the "distortion function" onto the compensation plane. Corresponding allowance can be made in other matching techniques referred to above. One solution is to measure the apparent distortion of the chuck by viewing it in a direction along the chuck axis. It will be appreciated that corresponding steps may be necessary where the "tilt" is applied at the carrier axis, but the contact roll axis is set at an inclination to the horizontal.

Movable Contact Roll

In many package drive systems, the rotation axis of the package carrying chuck is held stationary during the winding operation and the contact roll is moved relative to it in order to enable package build. Such movement is generally performed by a linearly movable, roll carrying slide—see for example U.S. Pat. No. 3,999,715. The invention could be applied to such a system in the same way as it can be applied to a system similar to the shown in U.S. Pat. No. 4,394,985, namely by adaptation of linear slide guidance to a curvilinear guidance means. The problems of accurate manufacture would be the same in both cases.

Such a system would differ from that shown in U.S. Pat. No. 4,087,055 in that the slide movement and distortion compensation systems have been combined in a unitary machine geometry. In U.S. Pat. No. 4,087,055, these systems are separate.

The invention can be applied most readily to a system in which the axis of the contact roll is maintained stationary during the winding operation and the chuck is moved relative to the contact roll by movement of a chuck carrier swingable on an axis which is held stationary relative to the contact roll axis.

Degree of Compensation

Reference has been made above to the possibility of undercompensating a system in which the distortion tends to draw the chuck into contact with the contact roll. It will be appreciated that it may be desirable to overcompensate a system in which the distortion tends to draw the chuck away from the contact roll (e.g. as in FIG. 9). The best compromise may be a mixture of under- and overcompensation, with the less preferred form of compensation occurring in the early stage of a winding operation; for example, where distortion is tending to draw the chuck away from the contact roll, the system may be undercompensated in the initial stages of the winding operation and overcompensated in the later stages.

Pre-stressing of the chuck

The means for moving the chuck towards and away from the initial winding position can be used also to force the chuck and contact roll into parallelism in the initial winding position if they initially make localised ("point") contact with each other. A suitable means (piston and cylinder unit) is shown in U.S. Ser. No. 412,014 for the swingarm winder. A suitable means (a piston and cylinder unit with a drive transmitting gear system) is shown in U.S. Pat. No. 4,298,171 for a revolver machine. Alternative chuck moving systems can also be employed. Systems for moving the roll relative to a fixed chuck are also well-known—see for example U.S. Pat. No. 3,575,357.

I claim:

1. A winding maching for receiving and winding at least one thread into a cylindrical package comprising a cylindrical contact roll rotatable about a longitudinal roll axis and contacting the circumference of the package during formation thereof;

at least one chuck for receiving at least one bobbin tube for formation of the package thereon; and a carrier member having said chuck supported thereon in cantilever-fashion for rotation about a longitudinal chuck axis, said carrier member being rotatable about a predetermined carrier rotation axis to move said chuck towards and away from an initial winding position in which said tube contacts said contact roll, said carrier rotation axis being disposed in nonparallel relation to said contact roll axis and said chuck axis being disposed parallel to said contact roll axis at least at one position of said chuck during formation of the package.

2. A winding machine as claimed in claim 1 wherein said carrier member is a swing arm.

3. A winding machine as claimed in claim 1 where said carrier member is a revolver head rotatable about said carrier rotation axis.

4. A winding machine for receiving and winding at least one thread into a cylindrical package comprising a cylindrical contact roll rotatable about a longitudinal roll axis and contacting the circumference of the package during formation thereof;

at least one chuck for receiving at least one bobbin tube for formation of the package thereon;

a support means having said chuck mounted thereon cantilever-fashion for rotation about a longitudinal chuck axis; and means defining a mode of relative movement of said support means and said contact roll to position said chuck axis of an unloaded chuck in substantially parallel relation to said roll axis at only one relative position thereof while maintaining said contact roll and the thread package in contact with each other during formation of the thread package on said chuck.

5. A winding machine as claimed in claim 4 wherein said one relative position is an initial winding position of said chuck.

6. A winding machine as claimed in claim 1 or claim 4 wherein said contact roll is mounted with said roll axis in a fixed position in the machine.

7. A winding machine as claimed in claim 1 or claim 4 wherein said roll axis is substantially horizontal.

8. A winding machine as set forth in claim 1 or claim 4 wherein said chuck is movable along a path such that said chuck makes point contact with said roll at one end of said chuck and which further comprises means for pressing said chuck into parallelism with said contact roll.

9. A winding machine for thread package comprising:

a contact roll rotatably mounted for rotation about a longitudinal roll axis;

at least one chuck rotatably mounted for rotation about a longitudinal chuck axis, said chuck being movable into a winding position adjacent said contact roll to receive and wind a thread package thereabout wherein said chuck axis is disposed parallel to said roll axis in said winding position; and means for moving said chuck into said position such that said chuck axis is not parallel to said roll axis during such movement and thereafter moving said chuck away from said position while maintaining contact between the thread package and said roll.

10. A winding machine as set forth in claim 9 wherein said means includes an arm pivotally mounted for pivoting about a pivot axis and having said chuck mounted thereon in spaced relation to said pivot axis.

11. A winding machine for thread packages comprising a contact roll rotatably mounted for rotation about a longitudinal roll axis;

at least one chuck rotatably mounted for rotation about a longitudinal chuck axis; and means for moving at least one of said contact roll and said chuck relative to each other to position said roll axis and said chuck axis in parallel relation to each other with said roll and said chuck in position to wind a thread on said chuck with said roll in contact with a thread package forming on said chuck and out of parallel relation to each other with said roll and the thread package on said chuck remaning in contact with each other during formation of the thread package on said chuck.

12. A winding machine as set forth in claim 1 wherein said means is connected to said chuck to move said chuck relative to said contact roll.

13. A winding machine as set forth in claim 11 wherein said means is connected to said contact roll to move said contact roll away from said chuck.

14. A winding machine comprising a contact roll rotatable about a longitudinal axis;

at least one chuck; and a carrier member having said chuck supported thereon for rotation about a longitudinal chuck axis, said carrier member being rotatable about a predetermined carrier rotation axis to move said chuck towards and away from an initial winding position adjacent said roll to wind a thread thereon with said roll in contact with a package forming on said chuck, said carrier rotation axis and said chuck axis being disposed out of parallel relative to each other and said chuck axis being disposed parallel to said roll axis in said initial winding position.

15. A machine as claimed in claim 14 wherein said carrier member baises said chuck into contact with said roll as said chuck is moved into said initial winding position.

* * * * *